US005553599A

United States Patent [19]

Benavides

[11] Patent Number: 5,553,599

[45] Date of Patent: Sep. 10, 1996

[54] HANDBILL ASSEMBLY AND DELIVERY SYSTEM FOR HANDBILLS

[76] Inventor: Armando W. Benavides, 142 Ithica Dr., San Antonio, Tex. 78227

[21] Appl. No.: 447,823

[22] Filed: May 23, 1995

[51] Int. Cl.[6] ..... F41B 11/00; B65G 51/06; B65G 51/02

[52] U.S. Cl. ..... 124/73; 124/56; 124/61; 124/71; 124/41.1; 406/184; 406/187

[58] Field of Search ..... 124/56, 61, 70, 124/71, 73, 41.1; 406/184, 187

[56] References Cited

U.S. PATENT DOCUMENTS

| | | | |
|---|---|---|---|
| 1,066,990 | 7/1913 | Briggs et al. | 406/184 |
| 1,335,448 | 3/1920 | Menon | 124/11 |
| 1,488,761 | 4/1924 | MacMillan | 406/184 |
| 1,902,856 | 3/1933 | Jackson | 406/187 |
| 2,031,988 | 2/1936 | Tobelman | 406/187 |
| 2,116,860 | 5/1938 | Blaylock et al. | 89/1 |
| 2,620,189 | 12/1952 | Livermon | 124/41.1 X |
| 2,756,737 | 7/1956 | Resch, Jr. | 124/11 |
| 3,046,694 | 7/1962 | Holderer | 46/74 |
| 3,130,865 | 4/1964 | Ono et al. | 221/226 |
| 3,138,382 | 6/1964 | Barker et al. | 273/106.5 |
| 3,345,977 | 10/1967 | Hall | 124/11 |
| 3,653,538 | 4/1972 | Lamar | 221/1 |
| 4,240,769 | 12/1980 | Diaz | 406/187 X |

FOREIGN PATENT DOCUMENTS

| | | | |
|---|---|---|---|
| 282579 | 1/1928 | United Kingdom | 406/187 |

OTHER PUBLICATIONS

Short article and photo titled: *Jet Tubes Hurl Circulars From Moving Car; Popular Mechanics;* vol. 111, No. 5; (May 1959) p. 78. (Cited In Ref. Des. AB above).

*Primary Examiner*—Randolph A. Reese
*Assistant Examiner*—Thomas A. Beach
*Attorney, Agent, or Firm*—Robert A. McFall

[57] ABSTRACT

A handbill is rolled to form a coil that is retained within a collapsible cup as it is ejected from an elongated tube and delivered to its destination. The collapsible cup has a cylindrical wall and a bottom member at one end that does not contribute to the structural strength of the cup. The elongated tube is connected to a controllable source of pressurized fluid that is used to eject the handbill assembly from the tube. The handbill assembly and delivery system avoids the problems of prior assemblies and systems that projected cone-shaped paper flyers through the air.

11 Claims, 1 Drawing Sheet

HANDBILL ASSEMBLY AND DELIVERY SYSTEM FOR HANDBILLS

TECHNICAL FIELD

This invention relates generally to an assembly having handbill and delivery container components, and more specifically to such an assembly that is adapted for delivery by pneumatic ejection from a tube.

BACKGROUND ART

The desire of even person who has walked the streets delivering flyers or handbills door-to-door is to have some way to magically transport the flyers to each doorstep. One attempt to address this desire is described in U.S. Pat. No. 3,345,977, issued Oct. 10, 1967 to L. F. Hall. The Hall patent discloses a device for projecting paper cones through the air.

An advertising circular, or leaflet, is rolled into a cone shape and secured in that shape by adhesive tape. The taped cone is then inserted into the breach of a tube and fitted over a nozzle that extends a substantial distance into the cone. Compressed gas is then selectively released through the nozzle to impinge on the inner conical end of the cone and propel it through the air to a desired destination.

The Hall system has several inherent disadvantages. First, in contradiction of the statements made in the Hall patent, the sharply pointed end of the paper cone presented a serious risk of injury when projected at high velocity from a tube. If the cone struck a child, or even an adult, in the head, eyes, throat, or other vulnerable area, within the first few feet after ejection from the tube, them was a significant risk of injury. Also, the Hall system was able to project only a single cone containing a single sheet of material. If more than one sheet was included in the cone, the sheets would have to be secured together to prevent unwinding during flight and accordingly the cone, and especially the tip of the cone, would have a much greater stiffness. This would undesirably increase the risk of injury if the cone were to strike a vulnerable object.

Another disadvantage of the Hall system is that the cones had to be precisely rolled so that the base of the cone would fit within the barrel of the tube and yet slide over the expanded conical base of the nozzle. Thus, a great deal of care was required in forming, rolling, and taping the cones.

A method for delivering newspapers and similar relatively heavy objects in residential areas is described in U.S. Pat. No. 3,653,538, issued Apr. 4, 1972 to Robert L. Lamar. The Lamar system uses a compressed air-powered mechanical ram to launch the objects according to a preselected sequence program. Although rather complicated, the Lamar system appears to be useful for delivering relatively large, heavy articles, such as newspapers. However, the mechanical launcher arrangement would not be effective for projecting lightweight articles such as handbills, flyers, circulars and the like, through the air.

The present invention is directed to overcoming the problems set forth above. It is desirable to have a handbill assembly that is economical to produce and assemble, can be quickly and accurately delivered by ejection from a conventional tube connected to a source of compressed air, and poses no, or most very minimal, risk of injury to a person if struck by the assembly during delivery. It is also desirable to have such an assembly that is easily crushed if inadvertently stepped on after delivery.

SUMMARY OF THE INVENTION

In accordance with one aspect of the present invention, a handbill assembly comprises a cup member and a handbill. The cup member has a readily collapsible cylindrical wall having a predefined internal diameter, and a nonstructural bottom member that extends across one end of the cylindrical wall and forms a closed bottom of the cup. The other end of the cup member is open. The handbill is formed of one or more sheets of paper that are rolled to form a coil that has an unrestrained diameter that is greater than the inside diameter of the cup member. At least one third of the coiled handbill is disposed within the cup member.

In another aspect of the present invention, a handbill delivery system includes an elongated tube having spaced apart open and closed ends and a predetermined internal diameter. A control valve is disposed in fluid communication with a source of compressed fluid and the closed end of the elongated tube. The handbill delivery system also includes a collapsible cup having a cylindrical wall that has an external diameter that is less than the internal diameter of the elongated tube and a pair of spaced apart ends. The collapsible cup also has a nonstructural covering across one of its spaced apart ends that forms a closed bottom of the cup. When the collapsible cup is assembled in the elongated tube, the closed bottom of the cup is positioned in a direction facing the closed end of the elongated tube.

Other features of the handbill assembly include the collapsible cylindrical wall of the cup member being formed of cardboard, and the nonstructural bottom member being formed of single ply paper.

Other features of the handbill delivery system include the elongated tube having an opening in the tube adjacent the closed end for receiving a collapsible cup containing a handbill, and a sleeve that is slidably disposed on the elongated tube that is movable to a covering position over the opening.

BEST MODE FOR CARRYING OUT THE INVENTION

Figure 1:
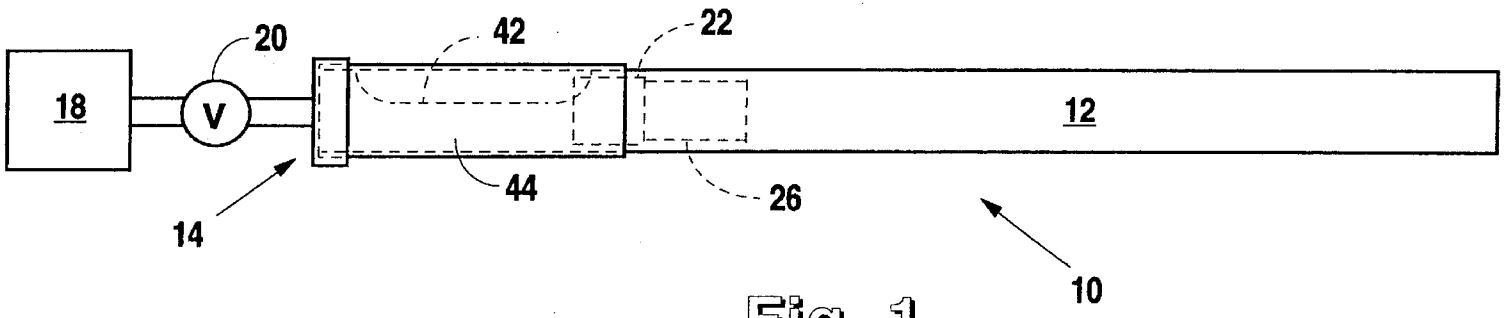
FIG. 1 is a schematic view of the handbill delivery system embodying the present invention.

A handbill delivery system 10 embodying the present invention is shown schematically in FIG. 1, and includes an elongated tube 12 having a closed end 14 and an open end 16 spaced from the dosed end 14. The preferred embodiment of the present invention is described below with specific reference to an illustrative example in which the elongated tube 12 is formed of conventional PVC plastic pipe having a nominal diameter of 3.175 cm (1¼ in). The actual internal diameter of the pipe forming the tube 12 is 3.5 cm (1⅜% in), and in the illustrative example described herein, has a length extending between the spaced ends 14,16 of about 91 cm (3 ft).

The handbill delivery system 10 also includes a source of compressed fluid 18, such as a portable air compressor or pressurized tank of air or other gas. A control valve 20 to control the flow of compressed fluid from the source 18 to the closed end 14 of the elongated tube 12 is connected by a flexible pressure hose to both components. In the illustrative example of the preferred embodiment of the present invention, the source of pressurized fluid 18 is a portable, gas engine driven, air compressor having a rating of 9.7 cfm (0.046 $m^3/s$) of compressed air at a pressure of 90 psi (62 $N/cm^2$). A pressure regulator, not shown, is set to provide 100 psi (69 $N/cm^2$) supply pressure to the closed end 14 of the tube 12. The control valve 20 is a trigger actuated valve commonly used with a conventional blow nozzle.

Figure 2:
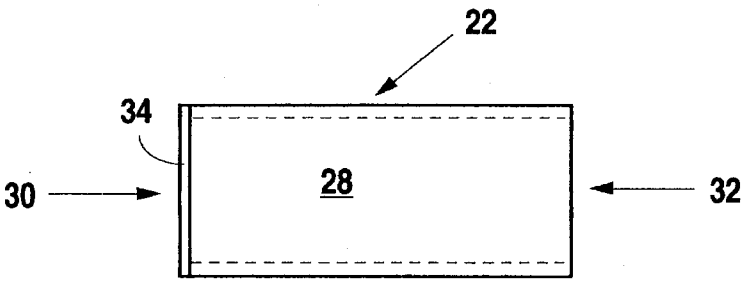
FIG. 2 is an elevational view of the cup member comprising one component of the handbill assembly embodying the present invention.
Figure 3:
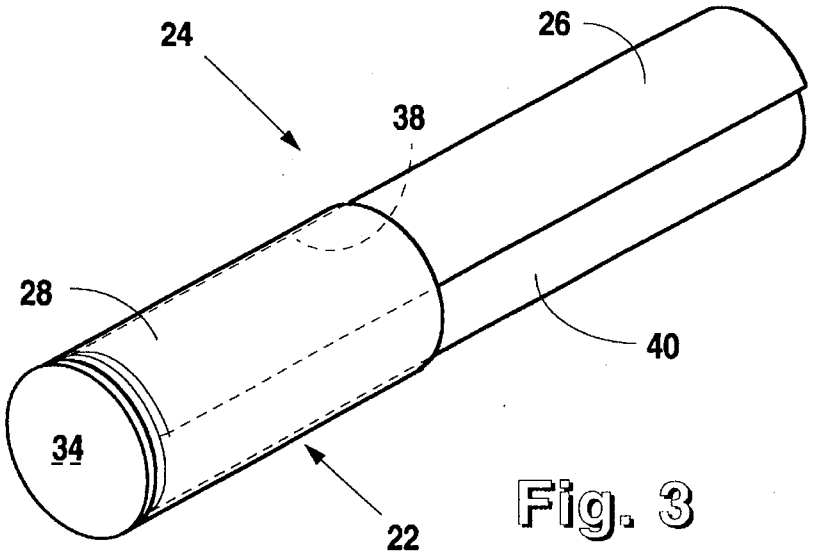
FIG. 3 is a perspective view of the handbill assembly embodying the present invention.

A key component of the handbill delivery system 10 is a collapsible cup 22, shown in FIG. 2, that forms one component of a handbill assembly 24. The term "cup" as used herein means a receptacle having an open top and a closed bottom. The terms "collapsible cup" and "readily collapsible wall" mean a cup or cup wall that can be easily crushed, or collapsed along its length if stepped on, even by a child. More specifically, the terms mean that the cup or cup wail will collapse when a static load of 6.8 kg (15 lbs) is applied to the respective structure. This feature of the present invention is important to present slipping in the event someone should step on a handbill assembly 24 that may be lying on a porch, sidewalk or driveway after delivery. If the cup 22, or the walls of the cup, are too rigid, the cup 22 will resist crushing and could roll, causing a person stepping on the cup to lose their balance. For this reason, it is important that the cup 22 itself and, as described below in more detail, its wall be readily collapsible.

As best shown in FIG. 2, the collapsible cup 22 embodying the present invention has a readily collapsible cylindrical wall 28, or tube, that is preferably constructed of lightweight cardboard or pasteboard. Cardboard or pasteboard are the preferred materials for the cup because they me economical and environmentally benign. However, the cup 22 may be constructed of other materials, such as plastic or metal foil, if the resultant structure is readily collapsible as defined above. The cylindrical wall 28 has predefined internal and external diameters, and a length that extends between a first end 30 and a spaced second end 32. Preferably, the collapsible cylindrical wall 28 has an internal diameter of from about 1.27 cm (0.5 in) to about 5.08 cm (2.0 inch), a wall thickness of from about 0.1 cm (0.04 in) to about 0.4 cm (0.16 in), and a length of from about 2.5 cm (1.0 in) to about 10.2 cm (4.0 in). In the illustrative example describing the preferred embodiment of the present invention, the internal diameter of the collapsible cylindrical wall 28 is about 3.0 cm (1.18 in), the external diameter about 3.4 cm (1.34 in), the wall thickness about 0.2 cm (0.08 in), and the length about 5.1 cm (2.0 in). Thus the outside diameter of the cylindrical wall 28 is only 0.1 cm (0.04 in) less than the internal diameter of the elongated tube 12, thus assuring minimal loss of pressurized fluid around the periphery of the cup member 22 during ejection. Preferably, the length of the cup member 22 is from about 1.5 to 4.0 times the internal diameter of the cylindrical wall 28 of the cup 22. In the above illustrative embodiment, the length of the cup member 22, defined as the distance between the spaced ends 30,32, is about 1.7 times the internal diameter of the cylindrical wall 28.

A bottom member 34 provides a nonstructural covering across the first end 30 of the collapsible cup member 22. The term "nonstructural" as used herein with respect to the bottom member 34 means that the bottom member 34 does not add any significant structural strength, or resistance to crushing, to the cylindrical wall 28. This feature of the present invention is important to assure that the cup member 22 retains it "readily collapsible" characteristics as described above.

In the preferred embodiment of the present invention, the bottom member 34 is a circular disk having an diameter substantially equal to the outside diameter of the cylindrical wall 28 and constructed of single ply paper having a standard weight of 50 lbs (22.7 kg). The single ply paper is adhesively attached to the first end 30 of the collapsible cup 22 by paste or glue. The bottom member 34 should have sufficient tear resistance to avoid splitting when impinged upon by compressed air during ejection from the elongated tube 12, yet not be so tightly adhered or structurally robust that it undesirably increases the crushability, or collapsibility, of the cylindrical wall 28. For these reasons, it is preferred that the bottom member be constructed of single ply paper having a standard weight of at least 16 lbs (7.3 kg) and no more than 110 lbs (49.9 kg). Alternatively, the bottom member 34 may be formed of a thin disk having a diameter substantially equal to the interior diameter of the cylindrical wall 28 and retained by either a nonstructural adhesive or by crimping a portion of the cylindrical wall 28 over the disk. In another arrangement, the bottom member 34 may be formed by crimping the cylindrical wall 28 to form a closure across the first end 30 similar to the crimped end of a shotgun shell or container for B-Bs. In another arrangement, the cup member 22 may be formed of papier-mache with the bottom member 34 integrally formed with the cylindrical wall 28 as a single molded article. Regardless of the construction of the bottom member 34, it is important that the bottom member 34 not disadvantageously contribute to the crush resistance of the cup member 22.

The second end 32 of the cup member 22 is open and serves as a receiver for the handbill 26. The term "handbill" as used herein means one or more sheets of a flyer, circular, leaflet, notice, placard, advertisement, commercial document or other paper. In forming the handbill assembly 24 embodying the present invention, the handbill 26 is rolled along either its width or length to form a coil having an unrestrained diameter that is greater than the internal diameter of the cylindrical wall 28 of the cup member 22. The paper, or papers, comprising the handbill 26 are loosely rolled and inserted into the second end 32 of the cup member 22 where, upon release, the rolled coil expands against the interior surface of the cylindrical wall 28 with sufficient force to retain the handbill 26 in the cup member 22 during ejection from the elongated tube 12 and subsequent flight through the air to its delivery destination. Upon insertion in the cup 22, a first portion 38 of the coiled handbill 26, extending along its coiled length, is positioned within the cup 22. To assure retention of the handbill 26 in the cup during ejection, flight and delivery, the first portion 38 of the rolled, or coiled, handbill 26 should be at least ⅓ of the total coiled length of the handbill 26, with the remaining, or second, portion 40 extending outwardly from the second end 32 of the cup 22. In the illustrative example, the handbill 26 includes two sheets of heavy weight paper, one measuring 10.8 cm (4¼ in) by 27.9 cm (11 in), and the other sheet measuring 9.5 cm (3¾ in) by 21.6 cm (8½ in), and having a combined weight of 8.5 g (0.3 oz).

Generally, several sheets of paper or handbills 26, depending upon their size and weight, can be rolled simultaneously, and inserted as a unit into the cup 22. However, there are several important considerations that should be addressed. First, the number of papers 26 inserted into the cup member 22 should not be so great as to inhibit the collapsibility of the cup member 22. Secondly, the total weight of the handbill assembly 24, including both cup member 22 and handbill 26, should not be so heavy as to be harmful if it should strike a person, window, or other structure during flight. For this reason, the total weight of the handbill assembly 24 should not exceed a few ounces. However, the total weight of the handbill assembly 24 must be sufficient to provide adequate throw ,distance. Preferably, the handbill assembly 24 has a weight of at least 5.7 g (0.2 oz), but no more than 113 g (4.0 oz).

In the illustrative embodiment de, scribed above, the handbill 26 comprises two sheets of heavy paper weighing about 8.5 g (0.3 oz), and the total weight of the handbill assembly 24, including the collapsible cup member 22, is about 17 g (0.6 oz). The handbill 26 was rolled with fire smaller sheet inside the larger sheet so that the length of the coiled roll was the width of the larger sheet, i.e., 10.8 cm (4 ¼ in). To assure proper balance of the handbill assembly 24 during ejection, rotation during flight, and cup-end delivery, it is desirable that the center of gravity, or balance point, of the handbill assembly 24 be positioned between the spaced ends 30.32 of the cup member 22. This means that the second portion 40 of the handbill 26 extending outwardly of the second end 32 of the cup 22 should not have a weight that is greater than the combined weight of the first portion 38 of the handbill 26 and the cup member 22.

In carrying out the delivery of handbills 26 using the delivery system 10 embodying the present invention, the elongated tube 12 has a longitudinal opening 42 adjacent the closed end 14 of the tube 12. The opening 42 has a width and length sufficient to receive one of the handbill assemblies 24. During ejection of the handbill assembly 24 from the elongated tube 12, the opening 42 is covered by sleeve 44 that is slidably mounted on the exterior of the tube 12 and positioned at a first position as shown in FIG. 1. The opening 42 is accessed for insertion of the handbill assembly 24 by sliding the sleeve 44 along the tube, toward the open end 16, to a second position spaced from the opening 42.

An important advantage of the handbill delivery system 10 embodying the present invention is that the handbill assembly 24 does not need to be precisely positioned within the elongated tube 12, as was required in the aforementioned system for delivering a paper cone. The handbill assembly 24 is inserted through the opening 42 with the bottom member 34 of the cup 22 facing toward the closed end 14 of the tube 12. The handbill assembly 24 may be inserted anywhere along the opening 42 and either left at that position in the tube 12, or even placed forward of the opening 42. It is not necessary that the bottom member 34 of the cup member 22 be positioned in contact with, or even closely adjacent, the closed end 14 of the elongated tube 12. After insertion of the handbill assembly 24 into the elongated tube 12, the sleeve 44 is moved to its first, or covering position over the opening 42. When it is desired to eject the handbill assembly, the valve 20, connected to a pressure line from the air compressor 18, is momentarily opened to admit pressurized fluid into the interior of the tube 12 through the pressure line connected to a fitting in the closed end 14 of the tube 12. The pressurized air then ejects the handbill assembly 24, the second portion 40 of the handbill 26 end first, through the open end 16 of the elongated tube 12. Immediately after leaving the open end 16 of the tube 12, the handbill assembly 24 rotates, or tumbles, end for end so that the cup end of the assembly 24 lands first. This feature assures good aerodynamic flow around the handbill assembly 24 during flight and makes it possible for an operator of the delivery system 10 to accurately spot the delivery position of the handbill assembly 24.

In the above described illustrative embodiment of the present invention, the elongated tube 12 has a length of about 91 cm (3.0 ft), and is capable, with the above stated 100 psi (69 N/cm$^2$) supply pressure, of projecting the described handbill assembly 24 having a weight of about 17 grams (0.6 oz), a distance of about 15 m (50 ft). It has been found that the flight distance of the ejected handbill assembly 24 can be increased by using a higher supply pressure or a longer tube 12, or a combination of both. Similarly, the flight distance may be decreased by either lowering the supply pressure or shortening the length of the elongated tube 12, or a combination of both.

In an actual test of the handbill delivery system 10 embodying the present invention, a crew of two people, one driver and one system operator, was able to deliver up to 5,000 of the handbill assemblys 24 in one eight-hour shift. Two people delivering the handbills door-to-door by walking, could deliver a total of only about 1,400 handbills per eight-hour day. Also, it took one vehicle with driver to support the two workers on foot.

Industrial Applicability

The handbill delivery system 10 embodying the present invention is particularly useful for delivery handbills, flyers, circulars, etc. from a moving vehicle. The compressed fluid source 18, either a small portable air compressor or pressurized tank, can be conveniently carded in the back of a pickup truck, and the pressure hose fed through a window, or other opening, into the cab. The elongated tube can be easily directed through an open window and, by selective triggering of the valve 20, project a handbill assembly 24 through the air and deposit it at a selected destination. With only minimal practice, an operator can become quite proficient at precisely placing a handbill in the middle of a designated target. The handbill delivery system 10 is easy to construct and maintain, and is assembled of easily obtained, relatively inexpensive components.

The handbill assembly 24 embodying the present invention provides an aesthetically desirable, safe, and economical arrangement for handbills 26. The handbill assembly has no pointed ends that could cause personal injury, and is easily crushable if accidentally stepped on. Furthermore, when constructed of cardboard and paper as described in the preferred embodiment of the present invention, the handbill assembly 24 is not environmentally disadvantageous.

Other aspects, features and advantages of the present invention can be obtained from a study of the drawings, this disclosure, and the appended claims.

What I claim is:

1. A handbill assembly for a pneumatic ejection system, comprising:

a cup member consisting of a readily collapsible cylindrical wall formed of cardboard and having a predefined internal diameter and two ends spaced apart at a predetermined distance, a nonstructural bottom member extending across one of said ends of the cylindrical wall and forming a closed end of said cup, and art open top at the other of said ends; and a handbill consisting of at least one sheet of paper rolled to form a coil having a length no more than about three times as long as the spaced distance between the ends of the cylindrical wall of the collapsible cup, a first portion extending along at least one-third of said coil length, a second portion extending along the remainder of said length, and an unrestrained diameter greater than the internal diameter of the cylindrical wall component of said cup, said first portion extending being disposed within the cup and said second portion extending outwardly from the open end of said cup.

2. A handbill assembly, as set forth in claim 1, wherein the nonstructural bottom member of said cup member is formed of single ply paper having a standard weight of from 7.25 kg (16 lb) to 50 kg (110 lb).

3. A handbill assembly, as set forth in claim 1, wherein the collapsible cylindrical wall of said cup member has a thickness of from about 0.1 cm (0.04 in) to about 0.4 cm (0.16 in).

4. A handbill assembly, as set forth in claim 1, wherein the internal diameter of said collapsible cylindrical wall is in a range of from about 1.27 cm (0.5 in) to about 5.08 cm (2.0 in).

5. A handbill assembly, as set forth in claim 1, wherein the cup member has a length defined by the distance between the spaced ends of the collapsible wall of the cup that is from about 1.5 to 4.0 times greater than the predefined internal diameter of said cylindrical wall.

6. A handbill assembly, as set forth in claim 1, wherein first portion of said coiled handbill comprises at least ⅓ of the total length of the rolled handbill.

7. A handbill assembly, as set forth in claim 1, wherein said assembly has a mass of at least 6 grams (0.2 oz) and a center of gravity that is positioned between the spaced ends of the cup member.

8. A handbill delivery system, comprising:

an elongated tube having a closed end, an open end spaced from said closed end, and a predetermined internal diameter;

a source of compressed fluid;

a control valve in fluid communication with said source of compressed fluid and the closed end of said tube;

a collapsible cup consisting of a cylindrical wall formed of cardboard and having an external diameter less than the internal diameter of said elongated tube and a pair of ends spaced apart at a predetermined distance, a nonstructural covering across one of said spaced ends forming a closed bottom of said collapsible cup, said closed bottom being disposed in a position facing the closed end of said elongated tube when said cup is assembled in the elongated tube.

9. A handbill delivery system, as set forth in claim 8, wherein the elongated tube has an opening adjacent the closed end of said tube, said opening having a width and length sufficient to receive said collapsible cup containing a handbill at least partially disposed therein through said opening, and a sleeve slidably disposed on said elongated tube and movable from a first position at which said sleeve covers the opening and a second position at which said sleeve is spaced from said opening.

10. A handbill delivery system, as set forth in claim 8, wherein the nonstructural covering forming the closed bottom of said collapsible cup is constructed of single ply paper having a standard weight of from 7.25 kg (16 lb) to 50 kg (110 lb).

11. A handbill delivery system, as set forth in claim 8, wherein the cylindrical wall of said collapsible cup has an external diameter that is from about 0.16 cm (0.625 in)to about 0.32 cm (0.125 in) less than the predetermined internal diameter of said elongated tube.

* * * * *